US008385729B2

(12) United States Patent
Kleman et al.

(10) Patent No.: US 8,385,729 B2
(45) Date of Patent: Feb. 26, 2013

(54) HEAT PUMP WATER HEATER AND ASSOCIATED CONTROL SYSTEM

(75) Inventors: Kelvin W. Kleman, Fort Smith, AR (US); Carl Bergt, Alma, AR (US); Randy R. Koivisto, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 581 days.

(21) Appl. No.: 12/634,322

(22) Filed: Dec. 9, 2009

(65) Prior Publication Data

US 2011/0058795 A1 Mar. 10, 2011

Related U.S. Application Data

(60) Provisional application No. 61/276,110, filed on Sep. 8, 2009.

(51) Int. Cl.
*F24C 1/00* (2006.01)

(52) U.S. Cl. ..... 392/308; 392/451; 392/454; 62/238.1

(58) Field of Classification Search ..... 392/308, 392/451–454
See application file for complete search history.

(56) References Cited

U.S. PATENT DOCUMENTS

| | | | |
|---|---|---|---|
| 2,668,420 | A | 2/1954 | Hammell |
| 2,690,649 | A | 10/1954 | Borgerd |
| 2,696,085 | A | 12/1954 | Ruff |
| 2,700,279 | A | 1/1955 | Stickel |
| 2,751,761 | A | 6/1956 | Borgerd |
| 3,837,174 | A | 9/1974 | Miyagi et al. |
| 4,041,726 | A | 8/1977 | Mueller et al. |
| 4,114,686 | A | 9/1978 | Mueller et al. |
| 4,134,273 | A | 1/1979 | Brautigam |
| 4,142,379 | A | 3/1979 | Kuklinski |
| 4,146,089 | A | 3/1979 | Mueller et al. |
| 4,179,902 | A | 12/1979 | Mueller et al. |
| 4,194,368 | A | 3/1980 | Bahel et al. |
| 4,226,606 | A | 10/1980 | Yaeger et al. |
| 4,242,872 | A | 1/1981 | Shaw |
| 4,255,936 | A | 3/1981 | Cochran |
| 4,263,785 | A | 4/1981 | Barniak et al. |
| 4,281,519 | A | 8/1981 | Spath et al. |
| 4,285,392 | A | 8/1981 | Rannow |
| 4,293,093 | A | 10/1981 | Raymond et al. |
| 4,293,323 | A | 10/1981 | Cohen |

(Continued)

FOREIGN PATENT DOCUMENTS

AU 2005202057 12/2005

OTHER PUBLICATIONS

PCT Search Report and Written Opinion, PCT/US 10/24453, Feb. 17, 2010.

(Continued)

*Primary Examiner* — Thor Campbell
(74) *Attorney, Agent, or Firm* — Haynes and Boone, LLP

(57) ABSTRACT

A heat pump water heater has a tank portion, an electric heating structure for adding electrical heat to water stored in the tank, and a heat pump for adding refrigerant heat to the tank water. A control system associated with the water heater has three user-selectable heating modes for heating the tank water during a given heating demand cycle—a first mode that initially heats the tank water with refrigerant heat while the electric heat is locked out for a first predetermined period before supplementing the refrigerant heat if necessary, a second mode similar to the first mode but with a longer electric heat lockout period, and a third mode in which only the electric heat is utilized to satisfy a tank water heating demand. Illustratively, the heat pump is disposed in a compact component arrangement on the top end of the water heater tank.

32 Claims, 4 Drawing Sheets

U.S. PATENT DOCUMENTS

| | | | |
|---|---|---|---|
| 4,299,098 | A | 11/1981 | Derosier |
| 4,305,456 | A | 12/1981 | Mueller et al. |
| 4,316,367 | A | 2/1982 | Yaeger et al. |
| 4,320,630 | A | 3/1982 | Uselton et al. |
| 4,321,797 | A | 3/1982 | Yaeger et al. |
| 4,336,692 | A | 6/1982 | Ecker et al. |
| 4,343,349 | A | 8/1982 | Busch, Jr. |
| 4,363,221 | A | 12/1982 | Singh |
| 4,366,677 | A | 1/1983 | Uselton |
| 4,368,624 | A | 1/1983 | Takeshita |
| 4,373,354 | A | 2/1983 | Sawyer |
| 4,386,500 | A | 6/1983 | Sigafoose |
| 4,399,664 | A | 8/1983 | Derosier |
| 4,429,547 | A | 2/1984 | Granryd |
| 4,441,902 | A | 4/1984 | Jardine |
| 4,448,040 | A | 5/1984 | Kunugi |
| 4,448,347 | A | 5/1984 | Dunstan |
| 4,483,322 | A | 11/1984 | Mori |
| 4,492,091 | A | 1/1985 | Whitwell et al. |
| 4,492,092 | A | 1/1985 | Smorol et al. |
| 4,513,585 | A | 4/1985 | Maisonneuve |
| 4,514,990 | A | 5/1985 | Sulkowski |
| 4,540,874 | A | 9/1985 | Shaffer, Jr. et al. |
| 4,575,001 | A | 3/1986 | Oskarsson et al. |
| 4,592,206 | A | 6/1986 | Yamazaki et al. |
| 4,596,123 | A | 6/1986 | Cooperman |
| 4,598,557 | A | 7/1986 | Robinson et al. |
| 4,646,537 | A | 3/1987 | Crawford |
| 4,646,541 | A | 3/1987 | Reid, Jr. et al. |
| 4,655,042 | A | 4/1987 | Kries |
| 4,665,712 | A | 5/1987 | Gehring et al. |
| 4,680,941 | A | 7/1987 | Richardson et al. |
| 4,685,307 | A | 8/1987 | Jones |
| 4,688,396 | A | 8/1987 | Takahashi |
| 4,693,089 | A | 9/1987 | Bourne et al. |
| 4,718,248 | A | 1/1988 | Fisher |
| 4,727,727 | A | 3/1988 | Reedy |
| 4,740,673 | A | 4/1988 | Robinson, Jr. |
| 4,754,614 | A | 7/1988 | Yuyama |
| 4,766,734 | A | 8/1988 | Dudley |
| 4,791,790 | A | 12/1988 | Tongu |
| 4,796,437 | A | 1/1989 | James |
| 4,798,240 | A | 1/1989 | Gerstmann et al. |
| 4,852,366 | A | 8/1989 | Harris |
| 4,856,578 | A | 8/1989 | McCahill |
| 4,893,476 | A | 1/1990 | Bos et al. |
| 4,894,998 | A | 1/1990 | Kaneko et al. |
| 4,909,041 | A | 3/1990 | Jones |
| 4,918,938 | A | 4/1990 | De Forest et al. |
| 4,955,930 | A | 9/1990 | Robinson, Jr. |
| 5,052,187 | A | 10/1991 | Robinson, Jr. |
| 5,220,807 | A | 6/1993 | Bourne et al. |
| 5,255,338 | A | 10/1993 | Robinson, Jr. et al. |
| 5,272,891 | A | 12/1993 | Erickson |
| 5,305,614 | A | 4/1994 | Gilles |
| 5,320,166 | A | 6/1994 | Swenson |
| 5,329,783 | A | 7/1994 | Yang |
| 5,351,502 | A | 10/1994 | Gilles et al. |
| 5,351,504 | A | 10/1994 | Giacometti et al. |
| 5,366,153 | A | 11/1994 | Swenson |
| 5,367,602 | A | 11/1994 | Stewart |
| 5,377,500 | A | 1/1995 | Yang |
| 5,465,588 | A | 11/1995 | McCahill et al. |
| 5,495,551 | A | 2/1996 | Robinson, Jr. et al. |
| 5,495,723 | A | 3/1996 | MacDonald |
| 5,558,273 | A | 9/1996 | Swenson et al. |
| 5,673,567 | A | 10/1997 | Dube |
| 5,673,569 | A | 10/1997 | Inoue |
| 5,761,925 | A | 6/1998 | Maeda |
| 5,772,113 | A | 6/1998 | Gerstmann et al. |
| 5,782,104 | A | 7/1998 | Sami et al. |
| 5,806,331 | A | 9/1998 | Brown |
| 5,906,109 | A | 5/1999 | Dieckmann et al. |
| 5,937,663 | A | 8/1999 | Chen et al. |
| 5,946,927 | A | 9/1999 | Dieckmann et al. |
| 5,971,289 | A | 10/1999 | Kurahashi et al. |
| 6,082,125 | A | 7/2000 | Savtchenko |
| 6,212,894 | B1 | 4/2001 | Brown et al. |
| 6,233,958 | B1 | 5/2001 | Mei et al. |
| 6,250,089 | B1 | 6/2001 | Serpente et al. |
| 6,263,964 | B1 | 7/2001 | Yang |
| 6,271,505 | B1 | 8/2001 | Henderson |
| 6,301,925 | B1 | 10/2001 | Funaba et al. |
| 6,311,504 | B1 | 11/2001 | Yamazaki et al. |
| 6,363,218 | B1 | 3/2002 | Lowenstein et al. |
| 6,370,896 | B1 | 4/2002 | Sakakibara et al. |
| 6,405,551 | B1 | 6/2002 | Kuwabara et al. |
| 6,418,737 | B1 | 7/2002 | Kuroki et al. |
| 6,430,949 | B2 | 8/2002 | Noro et al. |
| 6,460,360 | B2 | 10/2002 | Hsieh |
| 6,467,288 | B2 | 10/2002 | Kuroki et al. |
| 6,467,289 | B2 | 10/2002 | Kuroki et al. |
| 6,470,702 | B2 | 10/2002 | Funaba et al. |
| 6,494,051 | B2 | 12/2002 | Sakakibara et al. |
| 6,508,073 | B2 | 1/2003 | Noro et al. |
| 6,601,773 | B2 | 8/2003 | Saitoh et al. |
| 6,640,047 | B2 | 10/2003 | Murahashi et al. |
| 6,668,572 | B1 | 12/2003 | Seo et al. |
| 6,675,608 | B2 | 1/2004 | Inoue et al. |
| 6,837,443 | B2 | 1/2005 | Saitoh et al. |
| 6,874,694 | B2 | 4/2005 | Saitoh et al. |
| 6,907,923 | B2 | 6/2005 | Sienel |
| 6,945,062 | B2 | 9/2005 | Chen et al. |
| 6,984,948 | B2 | 1/2006 | Nakata et al. |
| 6,988,542 | B2 | 1/2006 | Hughes et al. |
| 7,003,964 | B2 | 2/2006 | Solomon |
| 7,010,925 | B2 | 3/2006 | Sienel et al. |
| 7,040,108 | B1 | 5/2006 | Flammang |
| 7,055,339 | B2 | 6/2006 | Hebert |
| 7,076,964 | B2 | 7/2006 | Sakakibara |
| 7,104,079 | B2 | 9/2006 | Kuwabara et al. |
| 7,127,905 | B2 | 10/2006 | Eisenhower et al. |
| 7,155,922 | B2 | 1/2007 | Harmon et al. |
| 7,155,927 | B2 | 1/2007 | Sawada et al. |
| 7,159,416 | B2 | 1/2007 | Park |
| 7,185,505 | B2 | 3/2007 | Kamimura |
| 7,225,629 | B2 | 6/2007 | Concha et al. |
| 7,228,692 | B2 | 6/2007 | Concha et al. |
| 7,234,646 | B2 | 6/2007 | Saitoh et al. |
| 7,310,960 | B2 | 12/2007 | Sienel et al. |
| 7,316,267 | B2 | 1/2008 | Kunimoto et al. |
| 7,334,419 | B2 | 2/2008 | Gordon et al. |
| 7,412,838 | B2 | 8/2008 | Hamanaka et al. |
| 7,454,919 | B2 | 11/2008 | Ookoshi et al. |
| 7,458,418 | B2 | 12/2008 | Sienel |
| 7,490,481 | B2 | 2/2009 | Eisenhower et al. |
| 7,506,616 | B2 | 3/2009 | Calvert |
| 2001/0020367 | A1 | 9/2001 | Funaba et al. |
| 2001/0032475 | A1 | 10/2001 | Chen et al. |
| 2001/0045102 | A1 | 11/2001 | Noro et al. |
| 2001/0048031 | A1 | 12/2001 | Noro et al. |
| 2002/0000094 | A1 | 1/2002 | Kuroki et al. |
| 2002/0002834 | A1 | 1/2002 | Kuroki et al. |
| 2002/0014085 | A1 | 2/2002 | Sakakibara et al. |
| 2002/0113133 | A1 | 8/2002 | Saitoh et al. |
| 2002/0146241 | A1 | 10/2002 | Murahashi et al. |
| 2003/0010049 | A1 | 1/2003 | Inoue et al. |
| 2003/0061827 | A1 | 4/2003 | Sakakibara |
| 2003/0178498 | A1 | 9/2003 | Saitoh et al. |
| 2004/0069006 | A1 | 4/2004 | Hebert |
| 2004/0112812 | A1 | 6/2004 | Kawabe et al. |
| 2004/0134647 | A1 | 7/2004 | Sienel |
| 2004/0144528 | A1 | 7/2004 | Kunimoto et al. |
| 2004/0154787 | A1 | 8/2004 | Hughes et al. |
| 2004/0200905 | A1 | 10/2004 | Saitoh et al. |
| 2004/0237557 | A1 | 12/2004 | Harmon et al. |
| 2005/0066678 | A1 | 3/2005 | Kamimura |
| 2005/0109490 | A1 | 5/2005 | Harmon et al. |
| 2005/0120730 | A1 | 6/2005 | Chen et al. |
| 2005/0126217 | A1 | 6/2005 | Park |
| 2005/0132732 | A1 | 6/2005 | Eisenhower et al. |
| 2005/0145370 | A1 | 7/2005 | Merryfull |
| 2005/0150969 | A1 | 7/2005 | Nakayama et al. |
| 2005/0155364 | A1 | 7/2005 | Concha et al. |
| 2005/0167516 | A1 | 8/2005 | Saitoh et al. |
| 2005/0172648 | A1 | 8/2005 | Concha et al. |
| 2005/0189431 | A1 | 9/2005 | Nakayama et al. |

2005/0193752 A1 9/2005 Eisenhower et al.
2005/0193753 A1 9/2005 Concha et al.
2005/0218240 A1 10/2005 Sienel
2005/0268625 A1 12/2005 Sienel et al.
2006/0011149 A1 1/2006 Stevens
2006/0038404 A1 2/2006 Kang et al.
2006/0060542 A1 3/2006 Sienel et al.
2006/0071090 A1 4/2006 Eisenhower et al.
2006/0080988 A1 4/2006 Zhang et al.
2006/0191276 A1 8/2006 Sienel et al.
2006/0191495 A1 8/2006 Sun
2006/0213209 A1 9/2006 Tanaami et al.
2006/0213210 A1 9/2006 Tomlinson et al.
2007/0012053 A1 1/2007 Eisenhower et al.
2007/0039341 A1 2/2007 Gordon et al.
2007/0119578 A1 5/2007 Shibata et al.
2007/0204636 A1 9/2007 Concha et al.
2007/0295018 A1 12/2007 Williams
2008/0023961 A1 1/2008 Cho et al.
2008/0092568 A1 4/2008 Ookoshi et al.
2008/0098760 A1 5/2008 Seefeldt
2008/0128526 A1 6/2008 Otake et al.
2008/0135636 A1 6/2008 Sakai et al.
2008/0210177 A1 9/2008 Calvert
2009/0013702 A1 1/2009 Murakami et al.
2009/0084329 A1 4/2009 Matsuoka et al.
2009/0145149 A1 6/2009 Sato et al.

OTHER PUBLICATIONS

Office Action mailed Mar. 1, 2012, issued by the Canadian Intellectual Property Office in Canadian Application No. 2,709,062, cover sheet and 3 pages.

HEAT PUMP WATER HEATER AND ASSOCIATED CONTROL SYSTEM

CROSS-REFERENCE TO RELATED APPLICATION

The present application claims the benefit of the filing date of provisional U.S. patent application No. 61/276,110 filed Sep. 8, 2009. The entire disclosure of the provisional application is hereby incorporated herein by this reference.

BACKGROUND OF THE INVENTION

This invention generally relates to liquid heating apparatus and, in a representatively illustrated embodiment thereof, more particularly relates to a specially designed heat pump water heater and associated control system.

In the past, various proposals have been made for operatively coupling a heat pump to an electric water heater to controllably add refrigerant heat to the water stored in the tank portion of the water heater during water heating demand cycles. Since the coefficient of performance of a heat pump is considerably better than the coefficient of performance of the electric resistance type heating structure of an electric water heater, this use of a heat pump provides an opportunity to substantially reduce the operating cost of an electric water heater to which it is operatively coupled, with the electric heating structure being available as a supplemental water heating mechanism should the heat pump fail or need heating supplementation.

As is well known in the water heater art, there is a tradeoff between the heating cost effectiveness of a heat pump and the more rapid water heating capability of an electric heating element. In conventionally constructed heat pump water heaters the user typically has little if any ability to selectively adjust the relationship between water heating cost effectiveness and water heating rapidity in the water heater to suit varying operating environments and hot water demand situations. An additional need that exists in the heat pump water heater area is the need for improvements in the placement and component arrangement of the heat pump portion of the water heater. It is to these needs that the present invention is primarily directed.

SUMMARY OF THE INVENTION

In carrying out principles of the present invention, in accordance with a representatively illustrated embodiment thereof, liquid heating apparatus is provided that comprises first apparatus operative to transfer refrigerant heat to a liquid, second apparatus operative to transfer electrical heat to the liquid, and a control system. The liquid heating apparatus illustratively includes an electric water heater having a tank for storing water to be heated, the first apparatus illustratively includes a refrigerant circuit structure, preferably a heat pump, operatively coupled to the electric water heater, and the second apparatus illustratively includes an electric resistance type heating structure extending through an interior portion of the tank.

According to an aspect of the overall invention, the control system may have a heating mode operative, in a heating cycle initiated in response to a sensed demand for liquid heating, to initially utilize the first apparatus, at the start of the heating cycle, to transfer refrigerant heat to the liquid while preventing operation of the second apparatus for a predetermined lockout period, thereafter utilize the second apparatus to supplement the refrigerant heating of the liquid with electrical heating thereof if the heating demand has not been satisfied by the previous refrigerant heating of the liquid, and then terminate the operation of both the first heating apparatus and the second heating apparatus at the end of the heating cycle when the demand for liquid heating is satisfied. The lockout of the second apparatus during each heating cycle in this heating mode is illustratively initiated only at the start of such heating cycle.

According to other aspects of the overall invention, the first apparatus may include a water circuit coupled to the tank and having a pump operative to draw water from a bottom portion of the tank and return the water to a top portion of the tank, the first apparatus may include a compressor, and the control system may be operative, if necessary, to utilize the second apparatus to heat the liquid to a predetermined minimum temperature prior to permitting operation of the compressor.

According to a further aspect of the overall invention, the control system may be operative to control the first apparatus and the second apparatus in either one of user-selectable first and second heating modes. The first heating mode, when selected, is operative in response a sensed demand for liquid heating to initially utilize the first apparatus to transfer refrigerant heat to the liquid, while preventing operation of the second apparatus for a predetermined first lockout period, and thereafter utilize the second apparatus to supplement the refrigerant heating of the liquid with electrical heating thereof if the heating demand has not been satisfied by the previous refrigerant heating of the liquid.

The second heating mode, when selected, is operative in response a sensed demand for liquid heating to initially utilize the first apparatus to transfer refrigerant heat to the liquid, while preventing operation of the second apparatus for a predetermined second lockout period of a different magnitude than the first lockout period, and thereafter utilizing the second apparatus to supplement the refrigerant heating of the liquid with electrical heating thereof if the heating demand has not been satisfied by the previous refrigerant heating of the liquid.

The control system may be additionally operative to control the first apparatus and the second apparatus in a third user-selectable heating mode which, when selected, is operative for only a predetermined time period to utilize only the second apparatus to transfer electric heat to the liquid in response to a sensed demand for liquid heating, the control system, after the expiration of the predetermined time period, automatically selecting one of the first and second heating modes for use in satisfying a sensed liquid heating demand.

According to a further aspect of the overall invention, the control system may be operative to control the first apparatus and the second apparatus in either one of user-selectable first and second heating modes. The first heating mode, when selected, is operative to utilize the first apparatus and, if needed, the second apparatus to transfer heat to the liquid in response to a sensed demand for liquid heating. The second heating mode, when selected, is operative, for only a predetermined time period, to utilize only the second apparatus to transfer heat to the liquid in response to a sensed demand for liquid heating, the control system, after the expiration of the predetermined time period, automatically selecting the first heating mode for use in satisfying a sensed liquid heating demand.

According to another aspect of the overall invention, the control system is operative to receive a desired liquid heating temperature set point input by a user of the liquid heating apparatus, and having a user-selectable heating mode which, in response to a sensed demand for liquid heating, initially utilizes the first apparatus to transfer refrigerant heat to the liquid, while preventing operation of the second apparatus for a predetermined first lockout period, and then utilizes the second apparatus to supplement the refrigerant heating of the liquid with electrical heating thereof if the heating demand has not been satisfied by the previous refrigerant heating of the liquid. If the user-input temperature set point is equal to or greater than a predetermined magnitude, the control system is automatically operative to implement a second heating mode similar to said first heating mode but having a predetermined second lockout period greater than the first lockout period.

In accordance with yet another aspect of the overall invention, water heating apparatus is provided comprising an electric water heater having a tank for storing water to be heated, and an electric heating element extending through an interior portion of the tank and operative to add electric heat to water therein. A refrigerant circuit structure has sequentially connected in series therein a compressor, a condenser coil operative to receive a throughflow of tank water to be heated by refrigerant passing through the condenser coil, an expansion valve, and an evaporator coil with an associated evaporator fan. The evaporator coil forms an outer wall portion of a plenum structure within the interior of which the compressor is disposed, the evaporator fan being operative, during operation of the refrigerant circuit structure, to flow air through the interior of the plenum structure and then outwardly through the evaporator coil, to thereby transfer heat from the fan and the compressor to the evaporator.

The water heating apparatus further comprises a water circuit extending between the tank and the condenser coil and having connected therein a pump operative to sequentially flow water from the tank, through the condenser coil and then back into the tank, and a control system operative to utilize the refrigerant circuit structure and the electric heating element to maintain a predetermined water temperature in the tank.

Preferably, the control system has a user-selectable heating mode operative in a given heating cycle to sequentially operate the refrigerant circuit structure and then operate the electric heating element, if necessary, to supplement the water heating of the refrigerant circuit structure. Illustratively, the tank has an upper end, and the refrigerant circuit structure is a heat pump disposed on the upper end of the tank.

DETAILED DESCRIPTION

Figure 1:
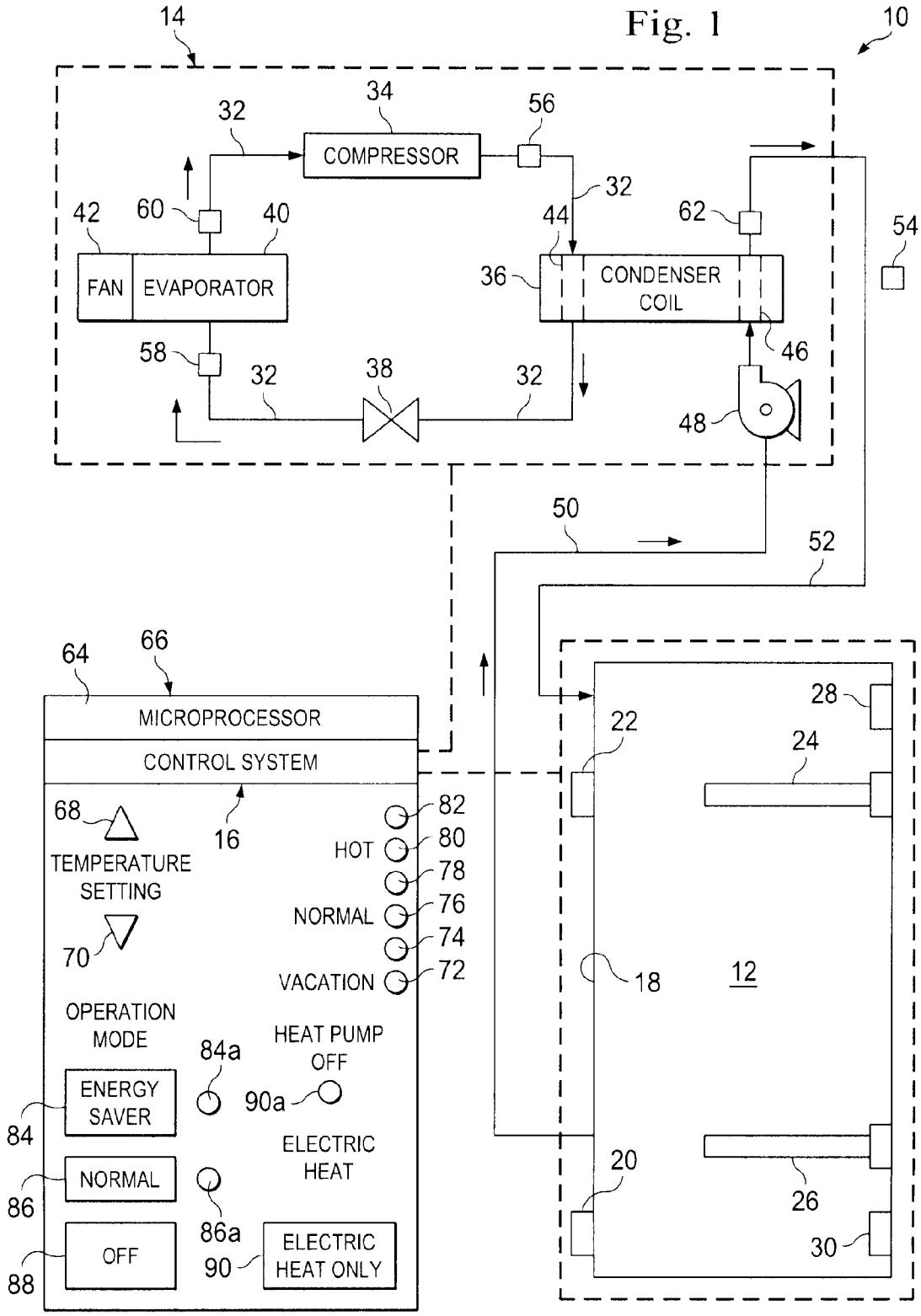
FIG. 1 is a schematic diagram of the water heater and control system.
Figure 2:
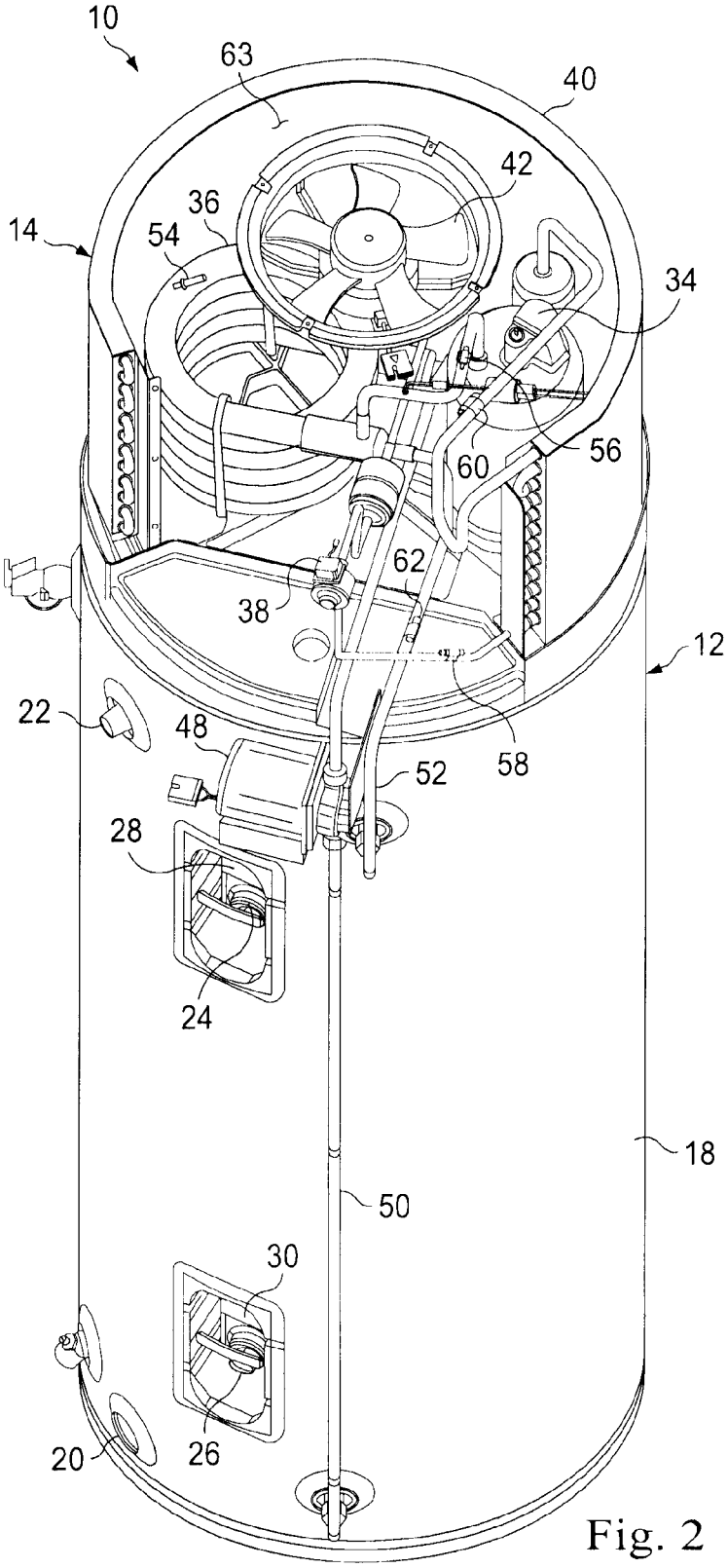
FIG. 2 is a partially cut away perspective view of the water heater.

Turning first to FIGS. 1 and 2, liquid heating apparatus representatively embodying principles of the present invention is designated generally by the reference numeral 10 and illustratively includes an electric water heater 12, a refrigerant circuit illustratively in the form of a heat pump 14, and a specially designed control system 16.

Water heater 12 has a vertically elongated cylindrical storage tank 18 for holding a quantity (representatively fifty gallons) of water to be heated. The tank 18 has a side-mounted cold water inlet 20 adjacent its lower end for receiving pressurized cold water from a source thereof, and a side-mounted hot water outlet 22 adjacent its upper end through which heated water may be periodically delivered, on demand, to hot water-utilizing fixtures such as sinks, bathtubs, showers, dishwashers and the like. Upper and lower electrical resistance heating elements 24,26 respectively extend through upper and lower interior portions of the tank 18. An upper tank thermistor 28 senses an upper tank water temperature, and a lower tank thermistor 30 senses a lower tank water temperature.

With continuing reference to FIGS. 1 and 2, the heat pump 14 (which may alternatively be another type of refrigerant circuit structure) includes a refrigerant piping circuit 32 in which a compressor 34, a condenser coil 36, an expansion valve 38 and an evaporator coil 40 having an associated evaporator fan 42 are connected in series as schematically depicted in FIG. 1. During operation of the heat pump 14, the compressor 34 forces refrigerant from its outlet through the piping circuit 32 sequentially through a first flow passage 44 in the condenser coil 36, the expansion valve 38, the evaporator coil 40 and back into the inlet of the compressor 34.

A second flow passage 46 (see FIG. 1) extends through the condenser coil 36 and is in thermal communication with the first condenser coil flow passage 44. A water pump 48 has its inlet coupled to a lower interior end portion of the tank 18 by a pipe 50, and its outlet coupled to the inlet of the condenser coil flow passage 46. The outlet of the flow passage 46 is coupled to an upper interior end portion of the tank 18 by a pipe 52. Accordingly, during operation of the heat pump compressor 34 and the water pump 48, heat from compressed refrigerant traversing the condenser coil passage 44 is transferred to water being pumped from the tank 18 through the condenser coil passage 46 and back to the tank 18 via the pipes 50 and 52 to thereby transfer refrigerant heat to the tank water.

A thermistor 54 senses the ambient temperature; a thermistor 56 senses the compressor discharge temperature; a thermistor 58 senses the evaporator coil inlet temperature; a thermistor 60 senses the evaporator coil suction temperature; and a thermistor 62 senses the condenser coil water discharge temperature. While the above-mentioned temperature sensing devices are representatively thermistors, it will be readily apparent to those of skill in this particular art that various other types of temperature sensors could alternatively be utilized without departing from principles of the present invention.

As shown in FIG. 2, the heat pump 14 is representatively mounted on the upper end of the water heater tank 18, with the evaporator coil 40 having a partially annular configuration which, in conjunction with associated top and side wall structures (removed in FIG. 2 for purposes of illustrative clarity) bounds a plenum 63 disposed on the upper end of the tank 18. The compressor 34 and the condenser coil 36 are disposed within the plenum 63. The evaporator fan structure 42 is centrally disposed on the top side of the annularly curved evaporator coil 40 and is operative to flow ambient air downwardly into the plenum 63 and then horizontally outwardly through the evaporator coil 40. This unique arrangement of the components of the heat pump 14 advantageously increases its operating efficiency by transferring both fan heat and compressor heat to the evaporator coil 40 via air being forced through the plenum 63 by the fan 42. Of course, the heat pump 14 could be mounted on the water heater 12 in a different manner, or be positioned remotely therefrom, if desired.

Referring again to FIG. 1, the control system 16 includes a microprocessor 64 preprogrammed to provide the water heater 12 and the heat pump 14 with a variety of subsequently described operational modes and control sequences that provide the water heating apparatus 10 with desirably enhanced operational flexibility and efficiency. Control system 16 also includes a user input touchpad input panel 66 that may be conveniently mounted on the exterior of the water heater tank 18 at a suitable location thereon.

In the representatively illustrated form thereof, the touchpad 66 has disposed on the face thereof up and down temperature setting arrows 68,70 which may be pressed by a user to increase or decrease the selected desired tank water temperature setting. To the right of the arrows 68,70 is a vertical column of temperature setting indicating lights 72,74,76,78,80,82 that respectively correspond to six user-selected water temperature settings having magnitudes that increase vertically from indicating light 72 to indicating light 82. Thus, for example, if the user wants to select a "normal" water temperature to be maintained in the tank 18 the user simply presses one of the temperature setting arrows 68,70 one or more times until the indicating light 76 is illuminated, indicating that a "normal" tank water temperature setting has been selected.

At the lower end of the touchpad 66 are four mode selection areas 84,86,88 and 90 which may be pressed by a user to select manners in which the water heating apparatus 10 will function. These touchpad areas 84,86,88,90 respectively correspond to an "energy saver" mode, a "normal" mode, an "off" mode, and an "electric heat only" mode. Pressing the "energy saver" area 84 illuminates a corresponding indicating light 84*a* on the touchpad 66, pressing the "normal" area 86 illuminates a corresponding indicating light 86*a* on the touchpad 66, and pressing the "electric heat only" area 90 illuminates a corresponding indicating light 90*a* on the touchpad 66.

As will be subsequently described in greater detail herein, the energy saver mode of the control system 16 assists the water heater 12 in obtaining maximum efficiency. The normal mode, on the other hand, is geared to maximizing the performance of the water heater 12 while still providing good energy savings. Each of these two modes, in a predetermined, somewhat different manner, first utilizes heat pump energy (in the form of refrigerant heat) to raise the water heater tank temperature before additionally utilizing electric heat if needed to fulfill a water heating demand. When selected, the electric heat only mode utilizes only electric heat to meet water heating demands, but is automatically limited to a set operational time period built into the control system. Upon expiration of this time period, the control system automatically returns the water heater to its previously selected normal or energy saver mode.

Figure 3A:
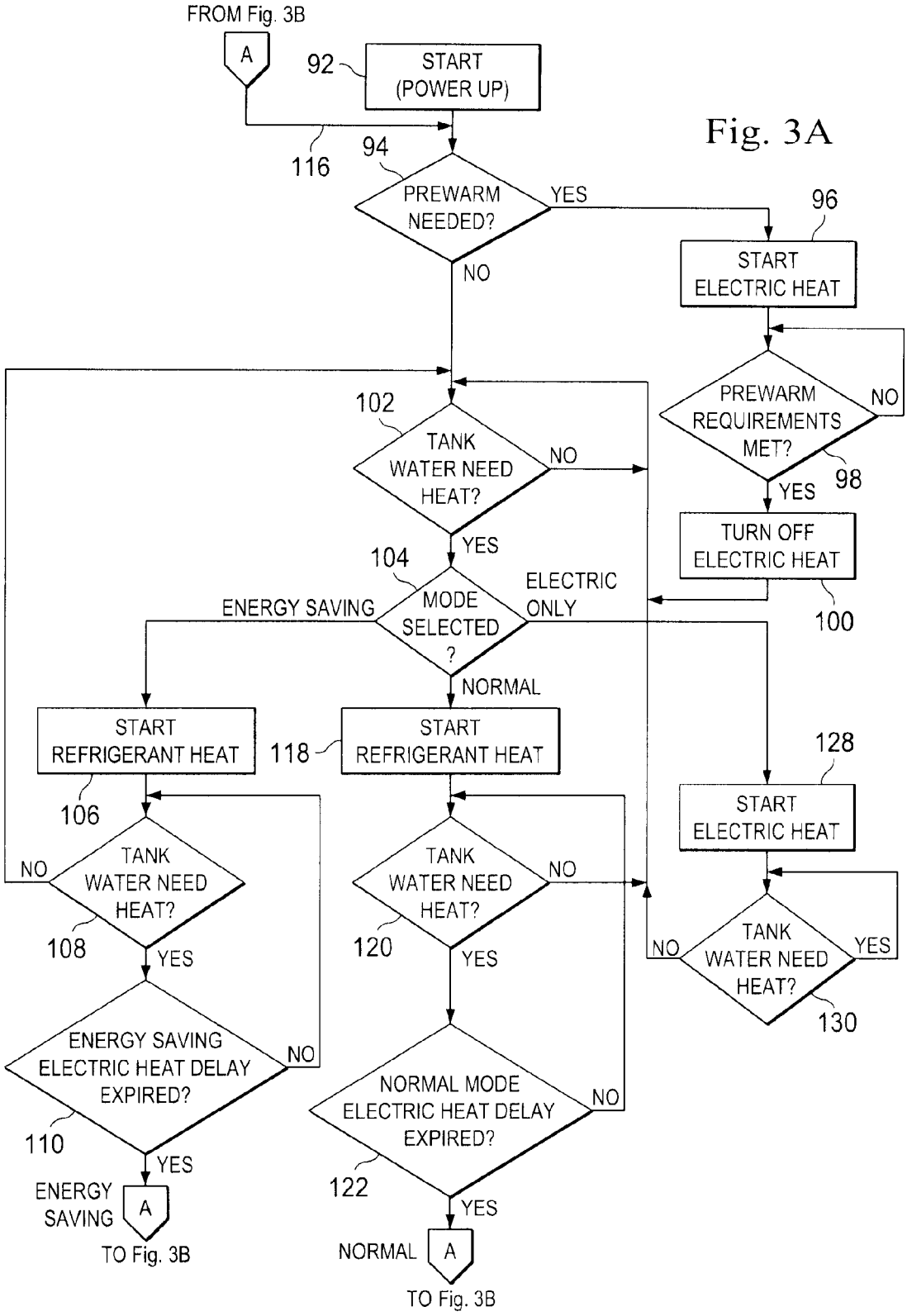
FIGS. 3A and 3B combinatively form a schematic flow diagram illustrating various control techniques utilized in conjunction with the water heater and associated control system.
Figure 3B:
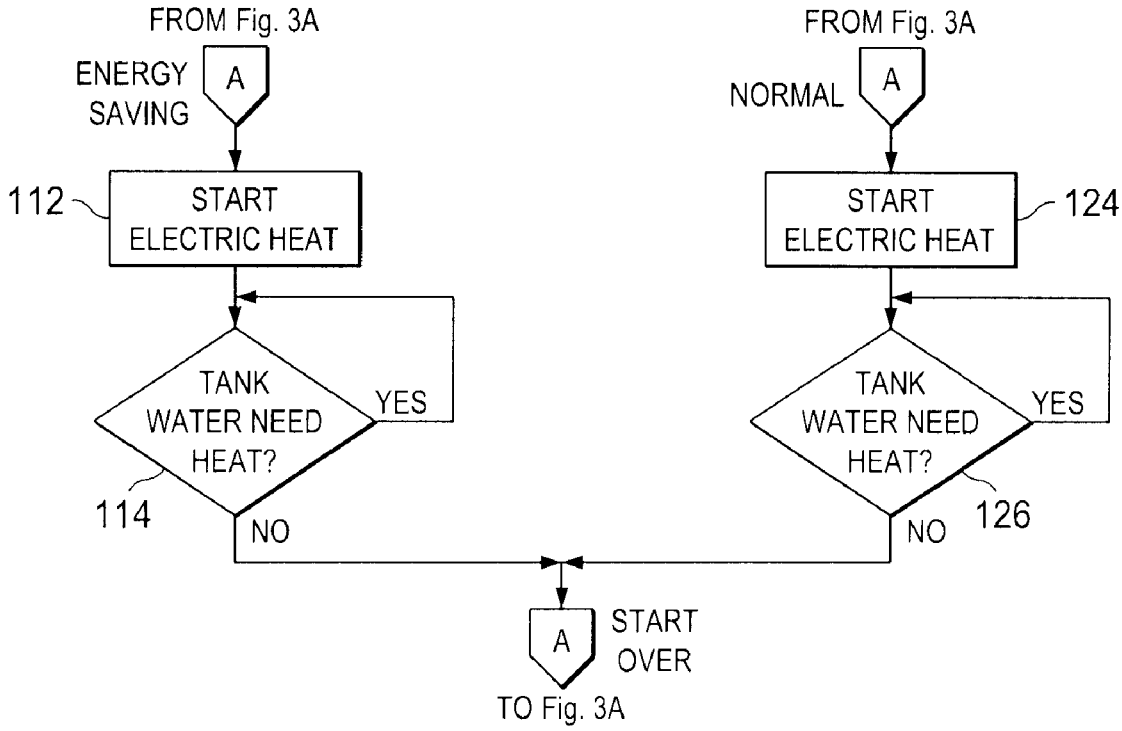

Turning now to the flow chart of FIGS. 3A and 3B, the modes and operational sequences of the water heater 12, carried out by the control system 16, will be more fully described. With initial reference to FIG. 3A, the water heating apparatus 10 is initially powered up at the start step 92 (by user selection of the energy saver, normal or electric heat only mode) after which a transfer is made to pre-warm test step 94. At step 94 a query is made as to whether the lower tank temperature (as sensed by thermistor 30) is less than a predetermined temperature (representatively 70° F.) and the upper tank temperature (as sensed by the thermistor 28) is less than or equal to a predetermined temperature (representatively 75° F.).

If both of these sensed temperature conditions are met, the control system 16 effects a transfer to step 96 at which a pre-warm cycle is initiated to heat the tank water to a predetermined minimum temperature (representatively 80° F.) to protect the compressor 34, at its subsequent start-up, by assuring that its initial discharge temperature (as measured by thermistor 56) is sufficiently high to prevent damage to the compressor 34. In response to the pre-warm cycle being initiated at step 96, the control system 16 energizes the water pump 48 at high speed, and energizes both of the electric heating elements 24 and 26. A transfer is then made to step 98 at which a query is made as to whether the sensed lower tank temperature is equal to or greater than its predetermined minimum temperature. While the answer to this query is negative, the tank water temperature continues to be monitored at step 98 until the query answer becomes positive, at which point the electric heat is de-energized at step 100 and a subsequent transfer is made to step 102.

At step 102 a query is made as to whether the tank water needs heat. If it does not, the control system 16 maintains the operational sequence at step 102 until it is determined at such step that the tank water does need heat from the water heating apparatus 10, at which point a transfer is made to step 104. At step 104 a query is made as to which operational mode (i.e., the energy saver mode, the normal mode or the electric heat only mode) has been selected. If the energy saver mode has been selected a transfer is made to step 106. At step 106, the heat pump 14 is started, to deliver refrigerant heat (via the circulation of water through pump 48) to the tank water, and electric heat is locked out for a predetermined delay period (representatively 45 minutes).

A transfer is then made to step 108 where a query is made as to whether the tank water needs heat. If the tank water does not need heat, a transfer is made back to step 102 wherein the system waits until there is another call for tank water heating. If it is determined at step 108 that the tank water does need heat, a transfer is made to step 110 at which a query is made as to whether the previously set electric heat delay (or "lockout") period set at step 106 has expired. If such delay period has not expired, the system continues to loop through steps 108,109 as indicated, until the delay period expires, at which point a transfer is made to step 112 (see FIG. 3B) at which point the electric heating of the tank water is initiated by energizing the upper electric heating element 24. Next, at step 114 a query is made as to whether the tank water needs heat. If it does, the system stays at step 114 until the step 114 query answer becomes negative, at which point both refrigerant and electric heating of the tank water are terminated, and a transfer is made back to flow chart point 116 (see FIG. 3A).

An adaptive mode, associated with the energy saver mode, is also preferably pre-programmed into the control system 16. If, at step 106, the user-selected tank water set point temperature is at or above a predetermined threshold magnitude (representatively, 130° F.), the adaptive mode is automatically initiated by the control system 16 in place of the energy saver mode to further increase the efficiency of the water heating apparatus 10. When this adaptive mode is automatically initiated at step 106, the electric heat delay period is set to a lesser time period (representatively 20 minutes) than in the energy saver mode, and a transfer is made to step 108 as previously described.

If at step 104 in FIG. 3A it is determined that the normal mode has been selected by the user, a transfer is made to step 118 at which point the heat pump 14 is started, to deliver refrigerant heat to the tank water, and electric heat is locked out for a predetermined delay period (representatively 30 minutes).

A transfer is then made to step 120 where a query is made as to whether the tank water needs heat. If the tank water does not need heat, a transfer is made back to step 102 wherein the system waits until there is another call for tank water heating. If it is determined at step 120 that the tank water does need heat, a transfer is made to step 122 at which a query is made as to whether the electric heat delay (or "lockout") period set at step 118 has expired. If such delay period has not expired, the system continues to loop through steps 120,122 as indicated, until the delay period expires, at which point a transfer is made to step 124 (see FIG. 3B) at which the electric heating of the tank water is initiated by energizing the upper electric heating element 24. Next, at step 126 a query is made as to whether the tank water needs heat. If it does, the system stays at step 126 until the step 126 query answer becomes negative, at which point both refrigerant and electric heating of the tank water are terminated, and a transfer is made back to flow chart point 116 (see FIG. 3A).

A normal high temperature mode, associated with the normal mode, is also preferably pre-programmed into the control system 16. If, at step 118, the user-selected tank water set point temperature is at or above a predetermined threshold magnitude (representatively, 130° F.), the normal high temperature mode is automatically initiated by the control system 16 in place of the normal mode to further increase the efficiency of the water heating apparatus 10. When this normal high temperature mode is automatically initiated at step 118, the electric heat delay period is set to a lesser time (representatively 15 minutes) than in the normal mode, and a transfer is made to step 120 as previously described.

If at step 104 in FIG. 3A it is determined that the electric heat only mode has been selected by the user, a transfer is made to step 128 at which point only the electric heat is energized (illustratively by energizing both of the upper and lower electric heating elements 24 and 26), without the heat pump 14 being utilized in this water heating mode. Preferably, also at step 128, a timer is automatically set (representatively for a two week time period). At the next step 130 a query is made as to whether tank water heating is needed. If it is, the system remains at step 130 until the tank water heating demand is satisfied at which point a transfer is made back to step 102 to await another electric heat-only heating demand. After expiration of the previously set timer period, the system automatically reverts to the previously set energy saver or normal mode (or to the default energy saver mode if one of these two modes was not selected before the electric heat only mode was selected). Additionally, at any time during this automatically set timer period the user may manually reset the system to another heating mode if desired.

The foregoing detailed description is to be clearly understood as being given by way of illustration and example only, the spirit and scope of the present invention being limited solely by the appended claims.

What is claimed is:

1. Liquid heating apparatus comprising:

first apparatus operative to transfer refrigerant heat to a liquid;

second apparatus operative to transfer electrical heat to the liquid; and a control system having a heating mode operative, in a heating cycle initiated in response to a sensed demand for liquid heating, to:

(1) initially utilize said first apparatus, at the start of the heating cycle, to transfer refrigerant heat to the liquid while preventing operation of said second apparatus for a predetermined lockout time period, (2) thereafter utilize said second apparatus to supplement the refrigerant heating of the liquid with electrical heating thereof if the heating demand has not been satisfied by the previous refrigerant heating of the liquid, and then (3) terminate the operation of both the first heating apparatus and the second heating apparatus at the end of the heating cycle when the demand for liquid heating is satisfied, the lockout of the second apparatus during each heating cycle in said heating mode being initiated only at the start of such heating cycle.

2. The liquid heating apparatus of claim 1 wherein:

said liquid heating apparatus includes an electric water heater having a tank for storing water to be heated, said first apparatus includes a refrigerant circuit structure operatively coupled to said electric water heater, and said second apparatus includes an electric resistance type heating structure extending through an interior portion of said tank.

3. The liquid heating apparatus of claim 2 wherein:

said refrigerant circuit structure is a heat pump.

4. The liquid heating apparatus of claim 2 wherein:

said refrigerant circuit structure has sequentially connected in series therein a compressor, a condenser coil operative to receive a throughflow of tank water to be heated by refrigerant passing through said condenser coil, an expansion valve, and an evaporator coil with an associated evaporator fan, said evaporator coil forming an outer wall portion of a plenum structure within the interior of which said compressor is disposed, said evaporator fan being operative, during operation of said refrigerant circuit structure, to flow air through the interior of said plenum structure and then outwardly through said evaporator coil, to thereby transfer heat from said fan and said compressor to said evaporator coil, and said first apparatus further includes a water circuit extending between said tank and said condenser coil and having connected therein a pump operative to sequentially flow water from said tank through said condenser coil and then back into said tank.

5. The liquid heating apparatus of claim 4 wherein:

said tank has a top end, and said refrigerant circuit structure is mounted on said top end of said tank.

6. The liquid heating apparatus of claim 4 wherein:

said pump is operative to draw water from a bottom portion of said tank and return the water to a top portion of said tank.

7. The liquid heating apparatus of claim 1 wherein:

said first apparatus includes a compressor, and said control system is operative, if necessary, to utilize said second apparatus to heat the liquid to a predetermined minimum temperature prior to permitting operation of said compressor.

8. Liquid heating apparatus comprising:

first apparatus operative to transfer refrigerant heat to a liquid;

second apparatus operative to transfer electrical heat to the liquid; and a control system operative to control said first apparatus and said second apparatus in either one of user-selectable first and second heating modes, said first heating mode, when selected, being operative in response a sensed demand for liquid heating to initially utilize said first apparatus to transfer refrigerant heat to the liquid, while preventing operation of said second apparatus for a predetermined first lockout time period, and thereafter utilizing said second apparatus to supplement the refrigerant heating of the liquid with electrical heating thereof if the heating demand has not been satisfied by the previous refrigerant heating of the liquid, and said second heating mode, when selected, being operative in response a sensed demand for liquid heating to initially utilize said first apparatus to transfer refrigerant heat to the liquid, while preventing operation of said second apparatus for a predetermined second lockout time period of a different magnitude than said first lockout time period, and thereafter utilizing said second apparatus to supplement the refrigerant heating of the liquid with electrical heating thereof if the heating demand has not been satisfied by the previous refrigerant heating of the liquid.

9. The liquid heating apparatus of claim 8 wherein:

said control system is additionally operative to control said first apparatus and said second apparatus in a third user-selectable heating mode which, when selected, is operative for only a predetermined time period to utilize only said second apparatus to transfer electric heat to the liquid in response to a sensed demand for liquid heating, said control system, after the expiration of said predetermined time period, automatically selecting one of said first and second heating modes for use in satisfying a sensed liquid heating demand.

10. The liquid heating apparatus of claim 8 wherein:

said liquid heating apparatus includes an electric water heater having a tank for storing water to be heated, said first apparatus includes a refrigerant circuit structure operatively coupled to said electric water heater, and said second apparatus includes an electric resistance type heating structure extending through an interior portion of said tank.

11. The liquid heating apparatus of claim 10 wherein:

said refrigerant circuit structure is a heat pump.

12. The liquid heating apparatus of claim 10 wherein:

said refrigerant circuit structure has sequentially connected in series therein a compressor, a condenser coil operative to receive a throughflow of tank water to be heated by refrigerant passing through said condenser coil, an expansion valve, and an evaporator coil with an associated evaporator fan, said evaporator coil forming an outer wall portion of a plenum structure within the interior of which said compressor is disposed, said evaporator fan being operative, during operation of said refrigerant circuit structure, to flow air through the interior of said plenum structure and then outwardly through said evaporator coil, to thereby transfer heat from said fan and said compressor to said evaporator coil, and said first apparatus further includes a water circuit extending between said tank and said condenser coil and having connected therein a pump operative to sequentially flow water from said tank through said condenser coil and then back into said tank.

13. The liquid heating apparatus of claim 12 wherein:

said tank has a top end, and said refrigerant circuit structure is mounted on said top end of said tank.

14. The liquid heating apparatus of claim 12 wherein:

said pump is operative to draw water from a bottom portion of said tank and return the water to a top portion of said tank.

15. The liquid heating apparatus of claim 8 wherein:

said first apparatus includes a compressor, and said control system is operative, if necessary, to utilize said second apparatus to heat the liquid to a predetermined minimum temperature prior to permitting operation of said compressor.

16. Liquid heating apparatus comprising:

first apparatus operative to transfer refrigerant heat to a liquid;

second apparatus operative to transfer electrical heat to the liquid; and a control system operative to control said first apparatus and said second apparatus in either one of user-selectable first and second heating modes, said first heating mode, when selected, being operative to utilize said first apparatus and, if needed, said second apparatus to transfer heat to the liquid in response to a sensed demand for liquid heating, and said second heating mode, when selected, being operative, for only a predetermined time period, to utilize only said second apparatus to transfer heat to the liquid in response to a sensed demand for liquid heating, said control system, after the expiration of said predetermined time period, automatically selecting said first heating mode for use in satisfying a sensed liquid heating demand.

17. The liquid heating apparatus of claim 16 wherein:

said liquid heating apparatus includes an electric water heater having a tank for storing water to be heated, said first apparatus includes a refrigerant circuit structure operatively coupled to said electric water heater, and said second apparatus includes an electric resistance type heating structure extending through an interior portion of said tank.

18. The liquid heating apparatus of claim 17 wherein:

said refrigerant circuit structure is a heat pump.

19. The liquid heating apparatus of claim 17 wherein:

said refrigerant circuit structure has sequentially connected in series therein a compressor, a condenser coil operative to receive a throughflow of tank water to be heated by refrigerant passing through said condenser coil, an expansion valve, and an evaporator coil with an associated evaporator fan, said evaporator coil forming an outer wall portion of a plenum structure within the interior of which said compressor is disposed, said evaporator fan being operative, during operation of said refrigerant circuit structure, to flow air through the interior of said plenum structure and then outwardly through said evaporator coil, to thereby transfer heat from said fan and said compressor to said evaporator coil, and said first apparatus further includes a water circuit extending between said tank and said condenser coil and having connected therein a pump operative to sequentially flow water from said tank through said condenser coil and then back into said tank.

20. The liquid heating apparatus of claim 19 wherein:

said tank has a top end, and said refrigerant circuit structure is mounted on said top end of said tank.

21. The liquid heating apparatus of claim 19 wherein:

said pump is operative to draw water from a bottom portion of said tank and return the water to a top portion of said tank.

22. The liquid heating apparatus of claim 16 wherein:

said first apparatus includes a compressor, and said control system is operative, if necessary, to utilize said second apparatus to heat the liquid to a predetermined minimum temperature prior to permitting operation of said compressor.

23. Liquid heating apparatus comprising:

first apparatus operative to transfer refrigerant heat to a liquid;

second apparatus operative to transfer electrical heat to the liquid; and a control system operative to receive a desired liquid heating temperature set point input by a user of said liquid heating apparatus, and having a user-selectable first heating mode which, in response to a sensed demand for liquid heating, initially utilizes said first apparatus to transfer refrigerant heat to the liquid, while preventing operation of said second apparatus for a predetermined first lockout time period, and then utilizes said second apparatus to supplement the refrigerant heating of the liquid with electrical heating thereof if the heating demand has not been satisfied by the previous refrigerant heating of the liquid, said control system being automatically operative, if the user-input temperature set point is equal to or greater than a predetermined magnitude, to implement a second heating mode similar to said first heating mode but having a predetermined second lockout time period greater than said first lockout time period.

24. The liquid heating apparatus of claim 23 wherein:

said liquid heating apparatus includes an electric water heater having a tank for storing water to be heated, said first apparatus includes a refrigerant circuit structure operatively coupled to said electric water heater, and said second apparatus includes an electric resistance type heating structure extending through an interior portion of said tank.

25. The liquid heating apparatus of claim 24 wherein:

said refrigerant circuit structure is a heat pump.

26. The liquid heating apparatus of claim 24 wherein:

said refrigerant circuit structure has sequentially connected in series therein a compressor, a condenser coil operative to receive a throughflow of tank water to be heated by refrigerant passing through said condenser coil, an expansion valve, and an evaporator coil with an associated evaporator fan, said evaporator coil forming an outer wall portion of a plenum structure within the interior of which said compressor is disposed, said evaporator fan being operative, during operation of said refrigerant circuit structure, to flow air through the interior of said plenum structure and then outwardly through said evaporator coil, to thereby transfer heat from said fan and said compressor to said evaporator coil, and said first apparatus further includes a water circuit extending between said tank and said condenser coil and having connected therein a pump operative to sequentially flow water from said tank through said condenser coil and then back into said tank.

27. The liquid heating apparatus of claim 26 wherein:

said tank has a top end, and said refrigerant circuit structure is mounted on said top end of said tank.

28. The liquid heating apparatus of claim 26 wherein:

said pump is operative to draw water from a bottom portion of said tank and return the water to a top portion of said tank.

29. The liquid heating apparatus of claim 23 wherein:

said first apparatus includes a compressor, and said control system is operative, if necessary, to utilize said second apparatus to heat the liquid to a predetermined minimum temperature prior to permitting operation of said compressor.

30. Water heating apparatus comprising:

an electric water heater having a tank for storing water to be heated, and an electric heating element extending through an interior portion of said tank and operative to add electric heat to water therein;

a refrigerant circuit structure having sequentially connected in series therein a compressor, a condenser coil operative to receive a throughflow of tank water to be heated by refrigerant passing through said condenser coil, an expansion valve, and an evaporator coil with an associated evaporator fan, said evaporator coil forming an outer wall portion of a plenum structure within the interior of which said compressor is disposed, said evaporator fan being operative, during operation of said refrigerant circuit structure, to flow air through the interior of said plenum structure and then outwardly through said evaporator coil, to thereby transfer heat from said fan and said compressor to said evaporator coil;

a water circuit extending between said tank and said condenser coil and having connected therein a pump operative to sequentially flow water from said tank, through said condenser coil and then back into said tank; and a control system operative to utilize said refrigerant circuit structure and said electric heating element to maintain a predetermined water temperature in said tank.

31. The water heating apparatus of claim 30 wherein:

said control system has a user-selectable heating mode operative in a given heating cycle to sequentially operate said refrigerant circuit structure and then operate said electric heating element, if necessary, to supplement the water heating of said refrigerant circuit structure.

32. The water heating apparatus of claim 30 wherein:

said tank has an upper end, and said refrigerant circuit structure is a heat pump disposed on the upper end of said tank.

* * * * *